United States Patent [19]

Schausberger

[11] 3,956,764

[45] May 11, 1976

[54] DEVICE FOR DETECTING THE PRESENCE OF PHOTOGRAPHIC FILM AS THE FILM TRAVELS ALONG A PREDETERMINED PATH THROUGH A FILM PROCESSING APPARATUS

[75] Inventor: Helmut Schausberger, Unterhaching, Germany

[73] Assignee: AGFA-Gevaert, A.G., Leverkusen, Germany

[22] Filed: Nov. 1, 1974

[21] Appl. No.: 520,202

[30] Foreign Application Priority Data

Nov. 8, 1973 Germany ..... 2355920

[52] U.S. Cl. ..... 354/298; 250/560; 250/561; 354/319; 354/339

[51] Int. Cl.[2] ..... G03D 13/00

[58] Field of Search ..... 354/298, 297, 319–321, 354/338–340; 250/560, 561

[56] References Cited

UNITED STATES PATENTS

| | | | |
|---|---|---|---|
| 3,392,708 | 7/1968 | Hunstiger | 354/297 |
| 3,472,143 | 10/1969 | Hixon et al. | 354/298 |
| 3,554,107 | 1/1971 | McCarthy et al. | 354/298 |
| 3,832,730 | 8/1974 | Geyken et al. | 354/319 X |

*Primary Examiner*—R. L. Moses
*Attorney, Agent, or Firm*—Michael J. Striker

[57] ABSTRACT

In the apparatus photographic film is transported along a predetermined path of travel. A flap structure is mounted for pivoting movement about a pivot axis between a rest position in which the flap structure blocks the path of film travel and a work position in which the flap structure does not block the path of film travel. The flap structure is so disposed as to be displaced to and maintained in the work position by film being transported along the path of film travel. The pivot axis of the flap structure is oriented parallel to the surface of the portion of the film which engages the flap structure and transverse to the direction of travel of the portion of the film which engages the flap structure. A detecting arrangement indirectly detects the travel of film along the path of film travel by detecting the pivotal displacement of the flap structure.

15 Claims, 2 Drawing Figures

DEVICE FOR DETECTING THE PRESENCE OF PHOTOGRAPHIC FILM AS THE FILM TRAVELS ALONG A PREDETERMINED PATH THROUGH A FILM PROCESSING APPARATUS

BACKGROUND OF THE INVENTION

The invention relates to an arrangement for the handling of photographic films, particularly sheet-like films provided with means for sensing the travel of the film through the arrangement, in particular for the purpose of controlling the operation of a regeneration arrangement.

Arrangements of this type having at least one pair of cooperating transport rollers are known. For the sensing of the passage of the film through the arrangement, there are provided detector switches comprised of sensing levers which move between a rest position, in which they rest in a recess in a counter pressure surface, and a work position, in which they ride on the surface of the travelling film. For films of relatively low sensitivity, such film detector devices can be satisfactorily employed. However, for some types of film, for example very-high-sensitivity X-ray films provided with photosensitive material on both film faces, the film exposure resulting from the applied pressure and the damage to the film surface are not acceptable.

It is also known to monitor the travel of the film through the film-processing arrangement indirectly through the use of very finely adjusted means operative for detecting the relative movements of pairs of transport rollers in the arrangement during the film travel. However, this expedient is very expensive.

Finally, it has been proposed to make use of sensors which are laterally displaceable out of the path of movement of the travelling film, so that these sensors would engage only the lateral edges of the travelling film. These sensing devices have the disadvantage that the film to be transported must be carefully positioned along one of the sides of the film guide track, in order to assure a reliable activation of the sensing device. Accordingly, there exists with such devices a considerable possibility of malfunction due to errors on the part of operating personnel, i.e., when the film is not precisely enough guided along the side of the guide track.

SUMMARY OF THE INVENTION

It is a general object of the invention to provide a sensing device capable of sensing the film travelling through a processing apparatus which, however, does not cause damage to the film being sensed.

This object, and others which will become more understandable from the description, below, of a preferred embodiment, can be met, according to one advantageous concept of the invention, by providing, in an apparatus for processing photographic film and the like, guide and transport means operative for guiding and transporting a photographic film along a predetermined path of travel; a flap structure mounted for pivoting movement about a pivot axis between a rest position in which said flap structure blocks said path of travel and a work position in which said flap structure does not block said path of travel, said flap structure being so disposed as to be displaced to and maintained in said work position by film being transported along said path by said guide and transport means, said pivot axis being oriented parallel to the surface of the portion of the film which engages said flap structure and transverse to the direction of travel of said portion of the film; and detecting means operative for indirectly detecting the travel of film along said path by detecting pivotal displacement of said flap structure.

As the film travels through the inventive sensing arrangement, the flap-like structure is pivotally displaced in the direction of film transport by the leading edge of the film, thereby unblocking the path of travel for the film. This pivotal displacement of the flap-like structure activates a detector which detects the pivotal displacement in question, thereby generating information concerning the presence of the film. Because a considerable pivotal displacement of the flap-like structure occurs, the means which senses such displacement need not be extremely precise, and use can be made of simple sensing elements, such as electrical switches, magnetic and photoelectric elements, and the like.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
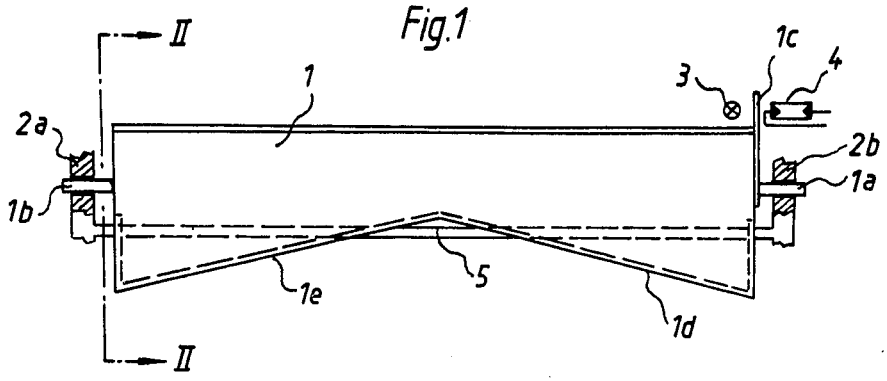
FIG. 1 depicts one sensing device according to the invention, as viewed in the direction of film transport.

In FIG. 1, reference numeral 1 generates a pivotable flap sturcture made of thin sheet aluminum, preferably 0.3 mm thick. The flap arrangement 1 is provided at its sides with short pivot shafts 1*a*, 1*b* pivotally supported in support members 2*a*, 2*b* fixedly mounted on the arrangement which incorporates the pivotable flap sturcture 1. The axis about which the flap structure 1 pivots is oriented parallel to the general plane of the film which is to be sensed during travel of the film and is oriented normal to the direction of travel of the film. The position of the pivot axis defined by the shaft sections 1*a*, 1*b* relative to the center of gravity of the entire pivotable flap sturcture 1 is such that, when the flap sturcture is pivotally displaced from its rest position (shown in FIG. 2) the gravitational restoring force, due to the inherent weight of the flap structure 1, which tends to return the flap structure 1 to the rest position, is relatively small. At the upper edge portion of the flap structure 1, the material of the flap structure 1 is bent backwards, i.e., in the direction opposite to the direction of film travel, to effect a stiffening and increase of rigidity of the flap structure 1.

The lower edge portion of the flap structure 1 is oriented at an angle of at least 2° to the general plane of the film transport plane defined by guide members 5, 5*a*. In the illustrated embodiment the inclination has been exaggerated, for the purpose of clarity. In the exemplary embodiment depicted in FIG. 1, the lower edge portion of the flap structure 1 is divided into two inclined sections 1d and 1e in such a manner that the breadth of the flap structure 1 increases in direction from the middle thereof outwards. At the lower edge of the flap structure 1, the sheet material of the flap structure 1 is bent forwards, i.e., in the direction of film transport, in order to increase the rigidity of the flap structure.

The flap structure 1 is provided with a projecting portion 1*c*, in this embodiment having the form of a light shield which moves into and out of a position in which it blocks the travel of light from a lamp 3 to a light detector 4.

When the flap structure 1 is in its illustrated rest position, the highest point of the lower edge portion of the flap structure 1 is located just slightly above the guide surface defined by the film support member 5. The angular inclination of the lower edge portion of the flap structure 1 should most advantageously be chosen in dependence upon the stiffness of the film; for example, in the case of relatively soft films the inclination can be greater than 2°, for example 5°.

Figure 2:
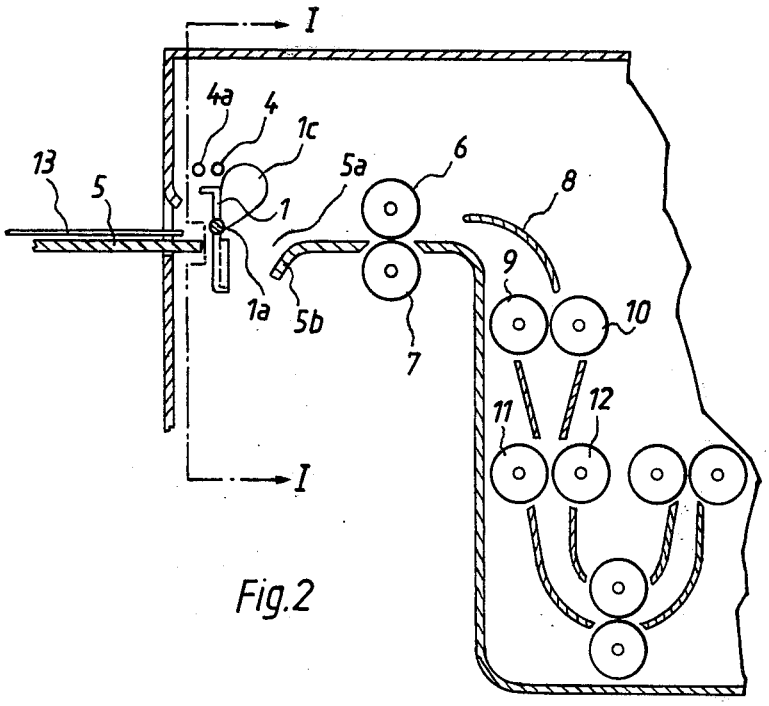
FIG. 2 is a side view of part of a film processing or handling arrangement incorporating the sensing device shown in FIG. 1.

FIG. 2 depicts not only the flap structure of FIG. 1, seen from the side, but also the inlet portion of a photographic developing apparatus provided with automatically operating transport rollers. Film support members 5 and 5*b* are spaced apart some distance, defining a gap 5*a*. The lower portion of the flap structure 1 occupies this gap 5*a* when the flap structure 1 is in the illustrated rest position. The film support member 5*b* is located upstream of the first pair of transport rollers 6, 7 and has an upstream portion which is bent downwards, in order to engage the possibly downwardly bent leading edge portion of a film travelling past the flap structure 1 and in order to properly guide such leading edge portion of the film into the rollers 6, 7. Arranged downstream of the transport rollers 6, 7 are deflecting elements 8 which guide the travelling film 13 to further pairs of transport rollers 9, 10 and 11, 12, etc.

The arrangement depicted in FIGS. 1 and 2 operates as follows:

A film 13 to be fed into the developing apparatus is laid onto the support member 5, oriented approximately centered relative to the flap structure 1, and is slid into the developing apparatus. The leading edge-portion of the film pushes against the flap structure 1 and causes the flap structure 1 to leave its rest position and pivot counterclockwise (as viewed in FIG. 2) to a progressively greater extent until the path of travel of the film becomes completely unblocked. When the leading edge portion of the film 13 initially engages the flap structure 1, it is evident that a very sizable length of the leading edge portion is in contact with the flap structure 1. However, as the flap structure 1 progressively pivots counterclockwise, less and less of the leading edge of the film actually contacts the flap structure. Finally, assuming the film is centered relative to the flap structure, the flap structure is contacted by only two points of the leading edge of the film, namely the two leading corners of the film. If the film is not centered relative to the flap structure 1, then only one of the two leading corners of the film contacts the flap structure during this final moment in the pivotal displacement of the flap structure, and the flap structure exerts upon the film a small centering force.

When the entire leading edge of the film 13 has passed through under the flap structure 1, the flap structure 1 is held in its fully displaced position, with the two inclined surface portions 1*d*, 1*e* at the bottom portion of the flap structure contacting only respective ones of the two lateral edges of the film. In this way, damage to the emulsion provided on the face of the film is precluded.

The pivotal displacement of the flap structure 1 occurring as the leading edge of the film enters into the developing apparatus is relatively large, and as a result the detection of such pivotal displacement, constituting an indirect detection of the presence of the film, can be performed in many different ways and does not require the use of very-high-precision detecting elements. As shown in FIG. 2 and mentioned above, the flap structure 1, in this embodiment is provided with a projecting portion 1*c* serving as a light shield. Pivotal displacement of the flap structure, such as described above, causes the light shield 1*c* to successively block the light paths defined by successive photoelements 4, 4*a* (see FIG. 2) and their respective light sources. In this way, a well-defined signal is generated when the pivotal displacement of the flap structure 1 has proceeded to a preselected minimum extent. If the film is fed into the developing apparatus centered relative to the flap structure 1, then the extent to which the flap structure 1 is pivotally displaced by the film is dependent upon the breadth of the film; accordingly, the use of the two photoelectric elements 4, 4*a*, or a greater number of them to provide increased resolution, readily lends itself to the generation of a signal not merely indicating the presence of film, but also the breadth of the film. In the illustrated embodiment the resolution of the arrangement, insofar as the detection of the breadth of the film is concerned, is very low, inasmuch as only two photoelectric light detectors 4, 4*a* are provided.

After the entire film has passed underneath the flap structure 1, the flap structure 1 is released and returns to its starting or rest position. Accordingly, the electrical signal afforded by the one or more photoelectric or other detectors 4, 4*a* returns to the starting value; in this sense, the duration of the sensing signal conveys information concerning the length of the film which has been transported.

Such signal, indicative of the length and/or breadth of the film, and in general indicative of the presence of the film, can be employed, in per se known manner, for the control of the dispensing of photographic processing fluid in the treatment container. With the use of two detectors, making it possible to distinguish between films having breadths above and below a predetermined value, a second dispensing pump can be activated or the rate of dispensing of processing fluid otherwise increased, when the presence of a relatively wide film has been automatically detected.

The elements which detect the angular position of the flap structure 1 need not be photoelectric elements and cooperating light sources, but can instead be of entirely different types. Use can readily be made of mechanical switches arranged to be held open or closed by means of linkage elements mechanically coupled to the pivotable flap structure 1, for as long as the flap structure 1 is held in the open position. Additionally, there are many ways of sensing the extent of the angular displacement of the pivotable flap structure 1 without mechanically engaging or contacting the flap structure 1. Use can be made of a variable-inductance detector comprised of a resonant circuit. The resonant circuit will include at least one inductor, the coils of which are stationarily arranged and the flux-permeable portion of which is mounted on the flap structure for movement therewith, but out of contact with the inductor coils. As the flap structure pivots to different extents, the inductance of the inductor, and accordingly the resonant frequency of the resonant circuit, varies. The change of resonant frequency of detuning of the resonant circuit constitutes an indication of the angular position of the flap structure 1. The flux-permeable portion of the inductor can be a simple piece of soft iron mounted on the side of the flap structure 1. Alternatively, use can be made of a plurality of such variable-inductance detectors, comprised of a respective plurality of resonant circuits, in order to generate distinguishable signals respectively indicative of different angles of displacement of the flap structure, and accordingly indirectly indicative of the breadth of the film being transported.

This measurement of the width of the film being transported can be performed particularly easily when the bottom portion of the flap structure 1 is comprised of only a single inclined part, instead of the two inclined parts of the ebodiment depicted. In such event, the film should be laid on that side of the support member 5 which is located beneath the highest part of the lower edge portion of the flap structure.

It will be understood that each of the elements described above, or two or more together, may also find a useful application in other types of construction differing from the types described above.

While the invention has been illustrated and described as embodied in a device for detecting film travelling into a film developing apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an apparatus for processing photographic film and the like, transport means operative for guiding and transporting a photographic film along a predetermined path of travel; a flap structure mounted for pivoting movement about a pivot axis between a rest position in which said flap structure blocks said path of travel and a work position in which said flap structure does not block said path of travel, said flap structure being so disposed as to be displaced to and maintained in said work position by film being transported along said path by said transport means, said pivot axis being oriented parallel to the surface of the portion of the film which engages said flap structure and transverse to the direction of travel of said portion of the film; and detecting means operative for indirectly detecting the travel of film along said path by detecting pivotal displacement of said flap structure.

2. In an apparatus as defined in claim 1, wherein said pivot axis is oriented normal to the direction of travel or the portion of the film which engages said flap structure.

3. In an apparatus as defined in claim 1, wherein said flap structure has an edge portion located between said axis and the portion of the film which engages said flap structure, said edge portion being so inclined relative to the surface of the portion of the film which engages said flap structure that said flap structure is engaged only by edge portions of the travelling film.

4. In an apparatus as defined in claim 3, wherein the angle of inclination of said edge portion of said flap structure relative to the surface of the portion of the film which engages said flap structure is at least 2°.

5. In an apparatus as defined in claim 1, wherein said flap structure has an edge portion located between said axis and the portion of the film which engages said flap structure, said edge portion being comprised of two oppositely inclined parts so inclined relative to the surface of the portion of the film which engages said flap structure that said flap structure is engaged only by the lateral edges of the travelling film, whereby to avoid contact with and damage to the face of the film.

6. In an apparatus as defined in claim 5, wherein the angle of inclination of each of said oppositely inclined parts relative to the surface of the portion of the film which engages said flap structure is at least 2°.

7. In an apparatus as defined in claim 3, wherein said pivot axis is so positioned relative to the center of gravity of said flap structure that gravity exerts upon said flap structure a restoring force tending to return said flap structure to said rest position, and wherein said transport means is so oriented as to guide said transport film along a path extending beneath said flap structure and blocking return of said flap structure to said rest position during film transport.

8. In an apparatus as defined in claim 7, wherein said transport means includes a support member for supporting film being transported on a support surface of said support member, said flap structure when in said work position defining with said support member an opening through which film is transported by said transport means, and wherein the highest point of said edge portion of said flap structure is located slightly higher than said support surface when said flap structure is in said rest position.

9. In an apparatus as defined in claim 1, wherein said flap structure is made of sheet metal, and wherein said flap structure includes an edge portion located between said pivot axis and the portion of the travelling film which engages said flap structure and maintains said flap structure in said work position, and wherein said sheet metal of said flap structure at said edge portion thereof is bent in the direction of travel of film.

10. In an apparatus as defined in claim 1, wherein said detecting means comprises an inductive position detector arrangement.

11. In an apparatus as defined in claim 1, wherein said detecting means comprises a magnetic position detector arrangement.

12. In an apparatus as defined in claim 1, wherein said detecting means comprises a mechanical position detector arrangement.

13. In an apparatus as defined in claim 1, wherein said detecting means comprises a photoelectric position detector arrangement.

14. In an apparatus as defined in claim 1, wherein said detecting means comprises a resonant circuit including at least one inductive component, said inductive component including a stationary part and a moving part mounted on said flap structure for movement with the latter, said stationary part and said moving part being so oriented that the inductance of said inductive component and the resonance of said resonant circuit vary in dependence upon the extent of pivotal displacement of said flap structure.

15. In an apparatus as defined in claim 1, wherein said apparatus for processing photographic film and the like includes means for supplying a flow of photographic processing fluid, and wherein said flap structure has an edge portion located between said axis and the portion of the film which engages said flap structure, said edge portion being so inclined relative to the surface of the portion of the film which engages said flap structure that said flap structure is maintained pivotally displaced by film travelling along said path to an extent directly dependent upon the width of the film, and wherein said detecting means includes means for distinguishing between different degrees of pivotal displacement of said flap structure from said rest position and for accordingly indirectly distinguishing between travelling films of different widths, and control means connected to said detecting means and operative in dependence upon the detected degree of pivotal displacement of said flap structure for varying the flow of photographic processing fluid in said apparatus, whereby to vary the flow of processing fluid in automatic dependence upon film width.

* * * * *